United States Patent [19]

Cantrell

[11] 4,386,618

[45] Jun. 7, 1983

[54] CIGARETTE FILTER

[75] Inventor: Daniel V. Cantrell, Prospect, Ky.

[73] Assignee: Brown & Williamson Tobacco Corporation, Louisville, Ky.

[21] Appl. No.: 278,529

[22] Filed: Jun. 29, 1981

[51] Int. Cl.[3] ..... A24D 3/04

[52] U.S. Cl. ..... 131/336

[58] Field of Search ..... 131/336, 198 R, 198 A, 131/338, 339, 340, 344

[56] References Cited

U.S. PATENT DOCUMENTS

| | | | |
|---|---|---|---|
| 1,718,122 | 6/1929 | DeShon | 131/336 |
| 2,819,720 | 1/1958 | Burbig | 131/336 |
| 3,324,862 | 6/1967 | DeSimone | 131/336 |
| 3,789,855 | 2/1974 | Norman | 131/336 |
| 3,860,011 | 1/1975 | Norman | 131/336 |

FOREIGN PATENT DOCUMENTS

| | | | |
|---|---|---|---|
| 1075485 | 2/1960 | Fed. Rep. of Germany | 131/336 |

*Primary Examiner*—V. Millin

*Attorney, Agent, or Firm*—Charles G. Lamb

[57] ABSTRACT

A filter assembly for use with a cigarette includes a porous filter element with a longitudinally extending hollow tube extending from each end thereof, the filter element being circumscribed by a non-porous wrapping material. The filter assembly further includes a chamber axially aligned with the porous filter element and disposed between the filter element and a tobacco column. The chamber is provided with means to direct ventilating air into the hollow tube and means to direct smoke from the tobacco column into the filter element without mixing with the ventilating air. When in use, the smoke and ventilating air exit in separate streams, the smoke exiting in streams which surround the ventilating air exiting the filter through the hollow tube.

7 Claims, 6 Drawing Figures

CIGARETTE FILTER

BACKGROUND OF THE INVENTION

1. Field of the Invention

This invention relates to filters for cigarettes. In one aspect it relates to a filter with novel ventilating means therein. In another respect, the invention relates to a filter cigarette wherein the ventilating air and smoke exiting the filter are in separate streams.

2. Description of the Prior Art

It is well known in the art of filters for cigarettes to utilize ambient air for the dilution of the cigarette smoke prior to entering the smoker's mouth. The dilution of the smoke stream reduces the quantity of smoke particulates as well as gas phase components which are delivered to the mouth of the smoker. A number of means have been proposed and are utilized for introducing ventilating air into the cigarette. For example, the wrapper for the tobacco column may be made from a porous material which allows for introduction of air along the entire length of the cigarette thereby mixing and diluting the smoke stream as it passes therethrough. Also, the cigarette wrapper may be perforated at selected locations along the length of the cigarette to provide ports through which ventilating air enters the cigarette. Even further, it is known to perforate the wrapper of a filter on the end of a cigarette to allow for ventilating air to enter the filter for dilution of the smoke stream in the filter. Recently it has been proposed to make filters for cigarettes wherein the ventilating air and the smoke stream passing through the filter are in separate streams and do not mix until they exit the filter. These include U.S. Pat. No. 3,324,862; U.S. Pat. No. 3,390,684; U.S. Pat. No. 3,490,461; U.S. Pat. No. 4,023,576; U.S. Pat. No. 4,256,122; and, German Pat. No. 2,849,904.

SUMMARY OF THE INVENTION

The present invention advantageously provides a straightforward arrangement of a filter for a tobacco column for lowering tar predominantly by ventilation instead of filtration. The present invention further provides a filter ventilation system for a cigarette wherein the smoke and ventilating air streams exiting the filter are in separate streams. The present invention even further provides a filter ventilation system for a cigarette wherein the smoke and ventilating air exiting the filter are in separate streams, the ventilating air being surrounded by the exiting smoke.

Various other features of the present invention will become obvious to those skilled in the art upon reading the disclosure set forth hereinafter.

More particularly, the present invention provides in combination with a cigarette, a filter for the cigarette comprising a porous filter element of cylindrical configuration having a longitudinally extending hollow tube extending from end to end, the filter element being circumscribed by a non-porous wrapping material; and, a chamber disposed between the filter element and the tobacco column including means to direct ventilating air into the hollow tube, and means to direct smoke from the tobacco column into the filter element without mixing with the air.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
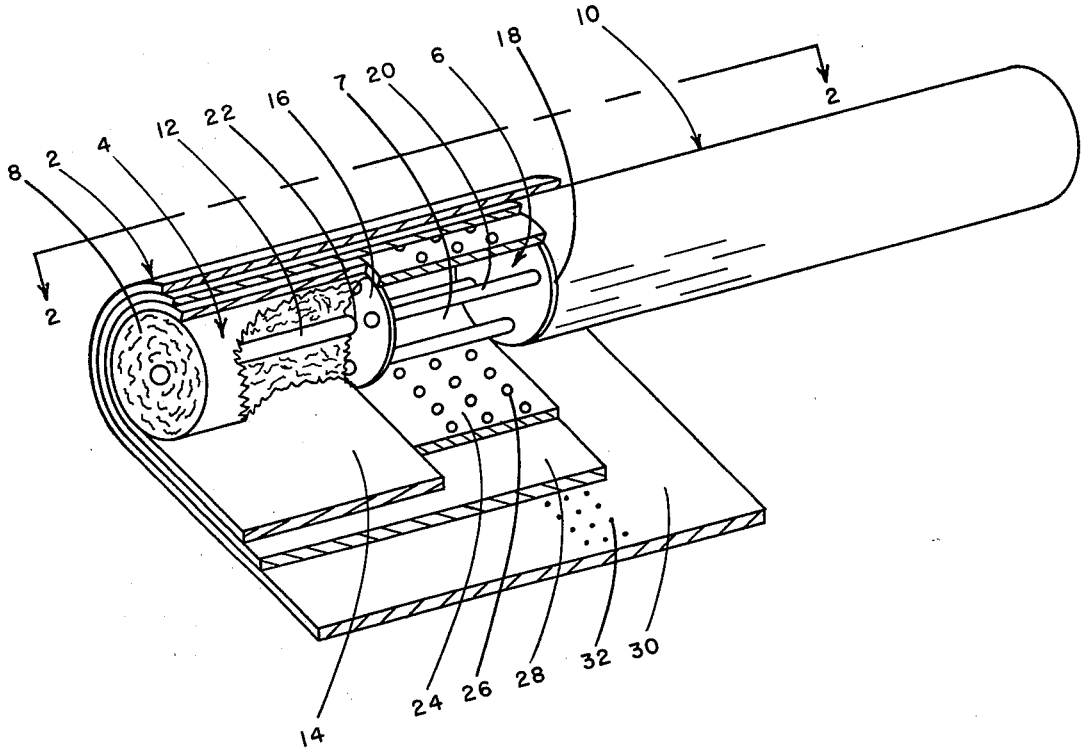
FIG. 1 is a perspective view of a preferred filter assembly of the present invention with selected portions cut away.
Figure 2:
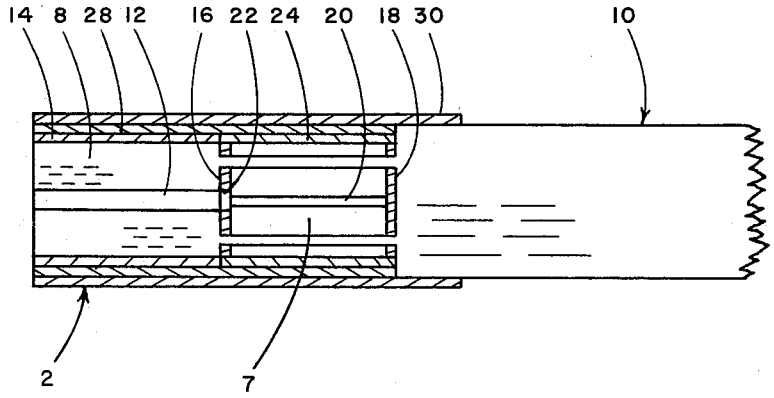
FIG. 2 is a sectional view of FIG. 1 taken along the line 2—2.

In FIGS. 1 and 2 a filter assembly 2 of the present invention is shown. This filter assembly 2 is divided into two axially aligned sub-assemblies 4 and 6, sub-assembly 4 being the mouth end of the filter assembly and sub-assembly 6 being the portion of the filter assembly which attaches to a tobacco column 10.

In the mouth end or sub-assembly 4, a porous filter element 8 of cylindrical configuration is provided with a hollow tube 12 which is generally a thin wall tubular plastic material longitudinally extending therethrough. The filter element 8 is generally a cellulose acetate filter element, but may be any other filter made from fibrous or foam materials which are known for use for filtering tobacco smoke. Sub-assembly 4 is circumscribed by a non-porous wrapper 14. In the use of the term "non-porous wrapper", this is meant to include non-porous outer surfaces of foamed material which are integral with the filter element as well as non-porous wrapping material which is separate from the filter element 8.

In the sub-assembly noted by the numeral 6, a pair of spaced transversely disposed circular discs 16 and 18 define each end of the sub-assembly 6. Discs 16 and 18 have provided therein aligned apertures to receive a plurality of longitudinally extending hollow tubes 20 therebetween, hollow tubes 20 being disposed so that smoke from tobacco column 10 travels into the filter element 8 when in use.

Disc 16 is also provided with an opening 22 to receive one end of the hollow tube 12. Hollow tube 12 is disposed to provide a passage for ventilating air from sub-assembly 6, as discussed hereinafter, out through the mouth end of the filter.

Circumscribing the sub-assembly 6 to form a chamber 7 with the discs 16 and 18 forming the ends is a sheet of porous wrapping material 24. The wrapping material 24 is provided with a plurality of flow-through apertures 26 therein to provide means to allow ventilating air to enter the sub-assembly 6.

As shown in the FIGS. 1 and 2, the sub-assemblies 4 and 6, respectively are circumscribed by a porous wrapper 28 and tipping material 30. Tipping material 30 is provided with a plurality of flow-through apertures 32 therein and extends beyond the filter assembly 2, overlapping the tobacco column 10 thereby attaching the filter assembly 2 to the tobacco column 10. It is realized that even though porous wrappers 24 and 28 are shown in a preferred embodiment, either or both may be eliminated without departing from the scope and spirit of the present invention.

In the use of a filter assembly of FIGS. 1 and 2 in combination with a tobacco column 10, smoke is drawn through tubes 20 of sub-assembly 6 into filter element 8 in sub-assembly 4 where it is subjected to particulate removal prior to exiting circumambiently of tube 12. Ventilating air enters sub-assembly 6 through ventilating aperture 32, porous wrapper 28 and ventilating apertures 26. Ventilating air then flows out of sub-assembly 6 by way of tube 12.

Figure 3:
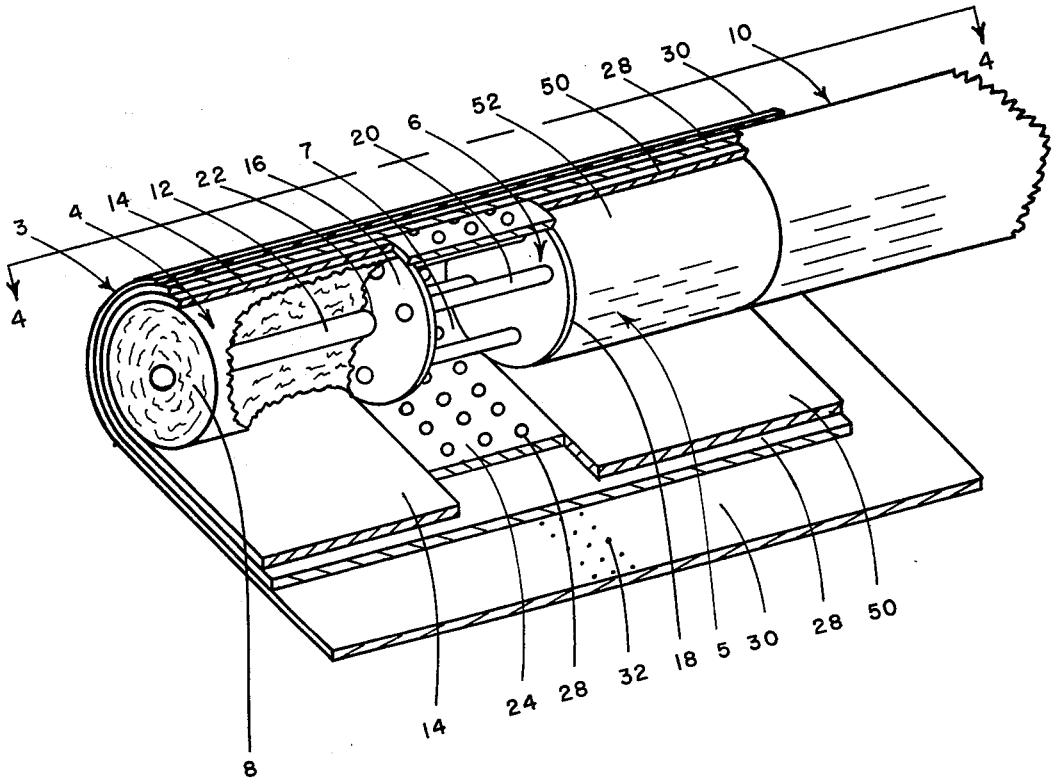
FIG. 3 is a perspective view of another filter assembly of the present invention with selected portions cut away.
Figure 4:
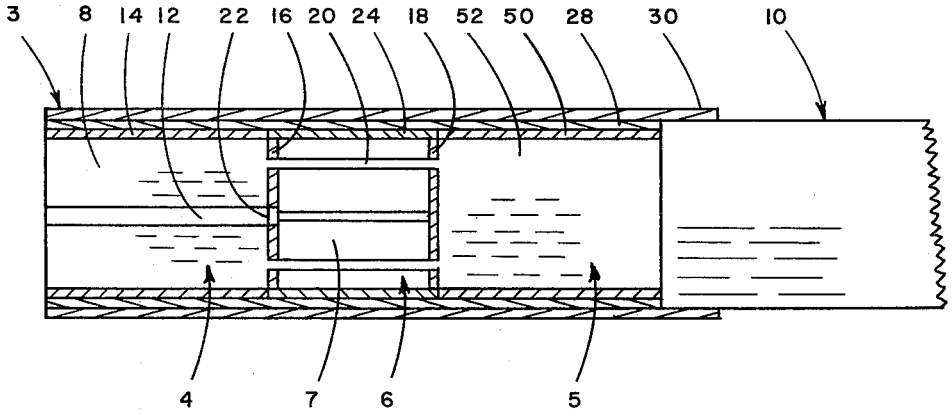
FIG. 4 is a sectional view of the filter assembly of FIG. 3 taken along the line 4—4.

In FIGS. 3 and 4, a filter assembly 3, which includes all of the elements of the filter assembly 2 described previously in reference to FIGS. 1 and 2, is shown attached to a tobacco column 10. Filter assembly 3 is made up of the sub-assemblies 4 and 6, as described hereinbefore, and in addition includes a third sub-assembly 5 or pre-filter for tobacco smoke prior to entering sub-assemblies 4 and 6. Sub-assembly 5 is axially aligned with and spaced between sub-assembly 6 and tobacco column 10. Sub-assembly 5 includes a porous filter element 52 of cylindrical configuration circumscribed by a wrapper 50. The filter element 52 and the wrapper 50 are generally of the same materials of construction as filter element 8 and non-porous wrapper 14, respectively, in sub-assembly 4. However, the material of construction may be different without departing from the scope and spirit of the present invention and the wrapper 50 may be porous as well as non-porous.

Sub-assembly 5 is circumscribed by the porous wrapper 28 and tipping material 30 which also circumscribes sub-assemblies 4 and 6 described hereinbefore. The tipping material 30 extends beyond the filter assembly 3, overlapping the tobacco column 10 thereby attaching the filter assembly 3 thereto.

In the use of a filter assembly of FIGS. 3 and 4 in combination with a tobacco column 10, smoke is drawn through sub-assembly 5 where it is subjected to a pre-filtration prior to being drawn through sub-assemblies 4 and 6 as described hereinbefore. As for the ventilating air, the ventilating air is moved through sub-assemblies 4 and 6 as described hereinbefore. Thus, the only difference between the filter assembly 2 and the filter assembly 3 is a pre-filter attached to the end of a tobacco column 10.

Figure 5:
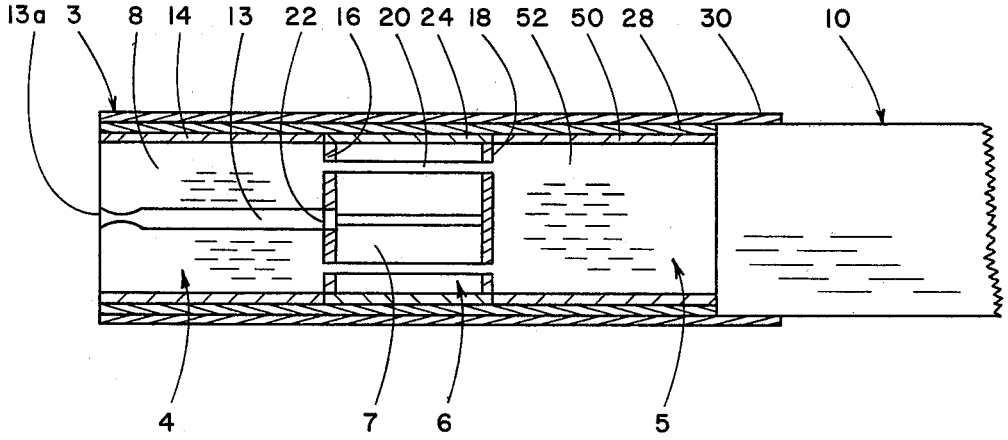
FIG. 5 is a sectional view of a modification of the filter assembly of FIG. 4; and, FIG. 6 is a perspective view of a modification of the mouth end of the filter assembly of FIG. 4 with selected portions cut-away.
Figure 6:
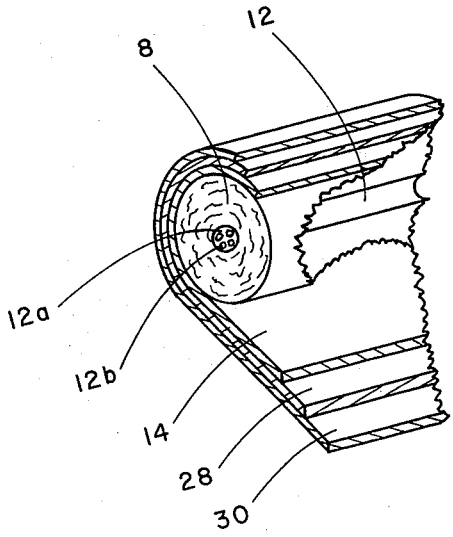

In FIG. 5, the hollow tube 12 is replaced with a hollow tube 13 having a "venturi"-type construction 13*a* in the exit end thereof. The "venturi"-type construction 13*a* causes the ventilating air to increase in velocity as it exits the filter assembly promoting vigorous mixing with the exiting smoke. In FIG. 6, hollow tube 12 is provided with a transversely disposed disc 12*a* at the mouth end having a plurality of holes 12*b* therein. Holes 12*b* are provided to divert the air into a number of separate streams to create higher air velocity exiting the filter assembly to promote vigorous mixing with the exiting smoke. It is also realized that other means for creating increased air velocity at the mouth end of the filter assembly may be used without departing from the scope and spirit of the present invention.

Thus, it will be realized that various changes may be made to the specific embodiments shown and described without departing from the scope and spirit of the present invention.

What is claimed is:

1. In combination with a tobacco column, a filter for said tobacco column comprising:

a first porous filter element of cylindrical configuration having a longitudinally extending first hollow tube extending from end to end, said first filter element being circumscribed by a non-porous wrapping material; and, a chamber disposed between said first filter element and said tobacco column including means to introduce ventilating air into said chamber, means to direct ventilating air into said hollow tube, and means to direct smoke from the tobacco column into said filter without mixing with said air.

2. The combination of claim 1 including a second filter element disposed between said chamber and said tobacco column whereby tobacco smoke is filtered prior to entering means to direct smoke from the tobacco column into said second filter element.

3. The combination of claim 1 wherein said longitudinally extending tube is co-axial with said filter element.

4. The combination of claim 1 wherein said means to direct ventilating air into said hollow tube includes a pair of spaced transversely disposed discs at each end of said chamber, one of said discs abutting said first filter element and being provided with an opening therein in flow-through communication with said first hollow tube.

5. The combination of claim 1 wherein said means to direct smoke from the tobacco column into said filter includes a pair of spaced transversely disposed discs, one at each end of said chamber, with a space aligned opening in each disc and a longitudinally extending second hollow tube in flow communication with said openings.

6. The combination of claim 1 wherein the mouth end of said first hollow tube includes a venturi type construction.

7. The combination of claim 1 wherein the mouth end of said first hollow tube includes a transversely disposed disc adjacent the mouth end thereof with a plurality of holes therethrough.

* * * * *

UNITED STATES PATENT AND TRADEMARK OFFICE

CERTIFICATE OF CORRECTION

PATENT NO. : 4,386,618

DATED : June 7, 1983

INVENTOR(S) : Daniel V. Cantrell

It is certified that error appears in the above—identified patent and that said Letters Patent is hereby corrected as shown below:

In column 4 - line 31 second should be changed to first.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*